US005718619A

United States Patent [19]

Merrill et al.

[11] Patent Number: 5,718,619

[45] Date of Patent: Feb. 17, 1998

[54] ABRASIVE MACHINING ASSEMBLY

[75] Inventors: Daniel L. Merrill, Grand Haven; John R. Synder, New Era; Chuck O. Eckholm, Jr., Montague; Steve M. Sunday, Rothbury; John L. Seaver, Montague, all of Mich.

[73] Assignee: CMI International, Inc., Southfield, Mich.

[21] Appl. No.: 731,027

[22] Filed: Oct. 9, 1996

[51] Int. Cl.[6] ..... B24B 5/00

[52] U.S. Cl. ..... 451/41; 451/247; 451/292; 451/285; 451/286; 451/287

[58] Field of Search ..... 451/283, 285–290, 451/294, 550, 214, 63, 41, 292, 247

[56] References Cited

U.S. PATENT DOCUMENTS

| | | | |
|---|---|---|---|
| Re. 24,777 | 2/1960 | Napp . | |
| 1,380,370 | 6/1921 | Fjellman . | |
| 1,505,282 | 8/1924 | Nevill . | |
| 1,605,160 | 11/1926 | Blood . | |
| 1,623,697 | 4/1927 | Oubridge . | |
| 1,634,745 | 7/1927 | Fraser . | |
| 2,033,922 | 3/1936 | Cole . | |
| 2,264,163 | 11/1941 | Indge . | |
| 2,375,333 | 5/1945 | Troendly et al. . | |
| 2,753,667 | 7/1956 | Whitelaw . | |
| 2,767,623 | 10/1956 | Hanson . | |
| 2,794,304 | 6/1957 | Frankiewicz et al. . | |
| 2,850,854 | 9/1958 | Levy . | |
| 2,990,659 | 7/1961 | Benkovich et al. . | |
| 3,078,589 | 2/1963 | Carlson . | |
| 3,629,979 | 12/1971 | Albers, Jr. et al. . | |
| 3,676,963 | 7/1972 | Rice et al. . | |
| 3,747,284 | 7/1973 | Lyczko . | |
| 3,890,114 | 6/1975 | Bovensiepen . | |
| 3,916,573 | 11/1975 | Elbe . | |
| 3,922,821 | 12/1975 | Canterbury . | |
| 3,925,936 | 12/1975 | Orlov et al. . | |
| 4,008,055 | 2/1977 | Phaal . | |
| 4,205,489 | 6/1980 | Orlov et al. . | |
| 4,239,501 | 12/1980 | Wirth . | |
| 4,272,924 | 6/1981 | Masuko et al. . | |
| 4,315,383 | 2/1982 | Day . | |
| 4,450,652 | 5/1984 | Walsh . | |
| 4,471,579 | 9/1984 | Bovensiepen . | |
| 4,481,741 | 11/1984 | Bouladon et al. . | |
| 4,771,578 | 9/1988 | Jorgensen et al. . | |
| 4,829,716 | 5/1989 | Ueda et al. | 451/292 |
| 4,882,878 | 11/1989 | Benner . | |
| 4,897,966 | 2/1990 | Takahashi . | |

(List continued on next page.)

FOREIGN PATENT DOCUMENTS

| | | | |
|---|---|---|---|
| 1502485 | 2/1969 | Germany | 451/292 |
| 90006834 | 6/1990 | WIPO | 451/287 |

*Primary Examiner*—Robert A. Rose
*Assistant Examiner*—George Nguyen
*Attorney, Agent, or Firm*—Howard & Howard

[57] ABSTRACT

An abrasive machining assembly (10) wherein a worktable (14) is rotatably supported on a frame (12) for rotation about a table axis (A) and a plurality of platens (32) are supported on the worktable (14) with each of the platens (32) being adapted for supporting a workpiece to be machined by a machining disc (38) rotating about a tool axis (B). Each platen (32) is rotatably supported for rotation about a platen axis (C) which is radially spaced from the table axis (A) a different distance than the tool axis (B) whereby each of the platens (32) rotates about a platen axis (C) which is parallel to and offset from the tool axis (B) when positioned in the workstation. The assembly is characterized by a drive mechanism for selective driving engagement with the workstation platen (32) to rotate the workstation platen (32) and for disengaging the workstation platen (32) during the indexing of the worktable (14) to move the workstation platen (32) out of the workstation while moving another platen (32) into the workstation. This drive mechanism comprises a vertically movable shaft (56) which is rotated by a pulley (70) and selectively moved up and down by a pneumatic actuator (64) to engage and disengage the workstation platen (32).

13 Claims, 4 Drawing Sheets

U.S. PATENT DOCUMENTS 5,016,399 5/1991 Vinson .
5,036,087 7/1991 Nishiguchi et al. ..... 451/285
5,081,795 1/1992 Tanaka et al. .
5,092,083 3/1992 Raffaelli .
5,121,572 6/1992 Hilscher ..... 451/286
5,127,196 7/1992 Morimoto et al. .
5,174,070 12/1992 Losch et al. .
5,194,071 3/1993 Corrigan et al. .
5,205,077 4/1993 Wittstock .
5,216,846 6/1993 Takahashi .
5,419,732 5/1995 Kaneko et al. .

32
36
C
34
36
24
18
A
32
36
34
32
36
14
60
56
62
20
22
16
60
70
58
66
66
68
64
30
26
28
12

ABRASIVE MACHINING ASSEMBLY

TECHNICAL FIELD

The present invention relates to the machining of workpieces which are rotatably supported on an indexing worktable for movement into a workstation under a machining disc.

BACKGROUND OF THE INVENTION

Various assemblies are known which machine a workpiece by rotating a flat machining disc against a workpiece which is rotated in the opposite direction about a parallel axis. The workpiece is supported on a platen which, in turn, rotatably supported on an indexable worktable. Such an assembly is shown in the international application number PCT/US89/05735 filed 21 Dec. 1989 and published under the Patent Cooperation Treaty (PCT) on 28 Jun. 1990 with International Publication Number: WO 90/06834.

The assembly disclosed in the aforementioned application utilizes a hydraulic motor to drive a planetary gear to rotate the platen under the machining disc.

SUMMARY OF THE INVENTION AND ADVANTAGES

An abrasive machining assembly comprising a frame rotatably supporting a worktable for rotation about a table axis with a plurality of platens supported on the worktable. Each of the platens is adapted for supporting a workpiece to be machined by a machining disc supported by the frame for rotation about a tool axis which is spaced radially of the table axis at a workstation. An indexing mechanism rotates the worktable to serially move each of the platens into the workstation to define a workstation platen and to subsequently move each of the platens out of the workstation. A lift mechanism moves the machining disc vertically into and out of engagement with a workpiece on the workstation platen. Each platen is rotatably supported for rotation about a platen axis which is radially spaced from the table axis a different distance than the tool axis whereby each of the platens rotates about a platen axis which is parallel to and offset from the tool axis when positioned in the workstation. The assembly is characterized by a drive mechanism for selective driving engagement with the workstation platen to rotate the workstation platen and for disengaging the workstation platen during the indexing of the worktable to move the workstation platen out of the workstation while moving another platen into the workstation.

BRIEF DESCRIPTION OF THE DRAWINGS

Other advantages of the present invention will be readily appreciated as the same becomes better understood by reference to the following detailed description when considered in connection the accompanying drawings wherein.

DETAILED DESCRIPTION OF THE PREFERRED EMBODIMENT

Figure 1:
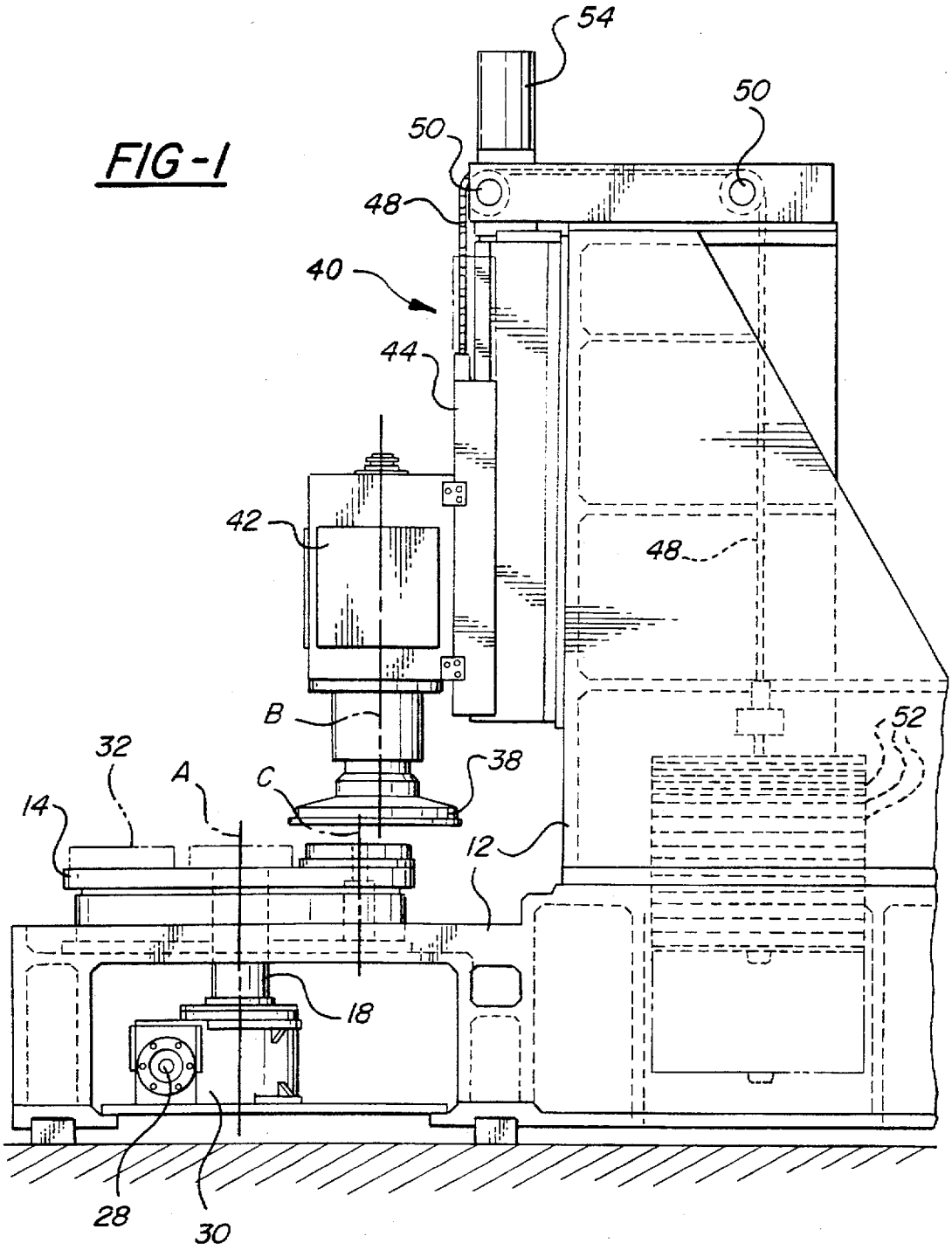
FIG. 1 is a side elevational view of a preferred embodiment.
Figure 2:
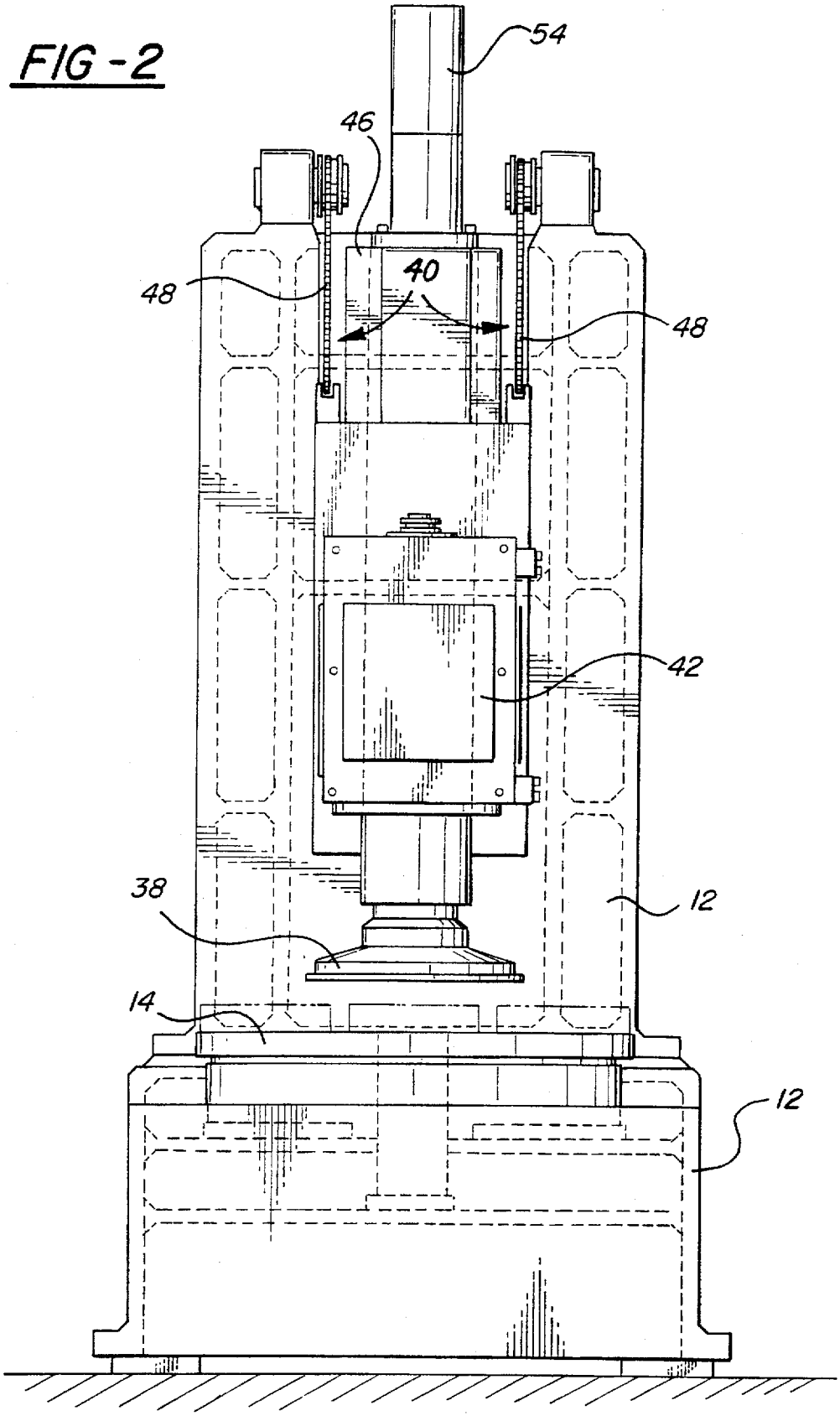
FIG. 2 is a front elevational view of the preferred embodiment.
Figure 3:
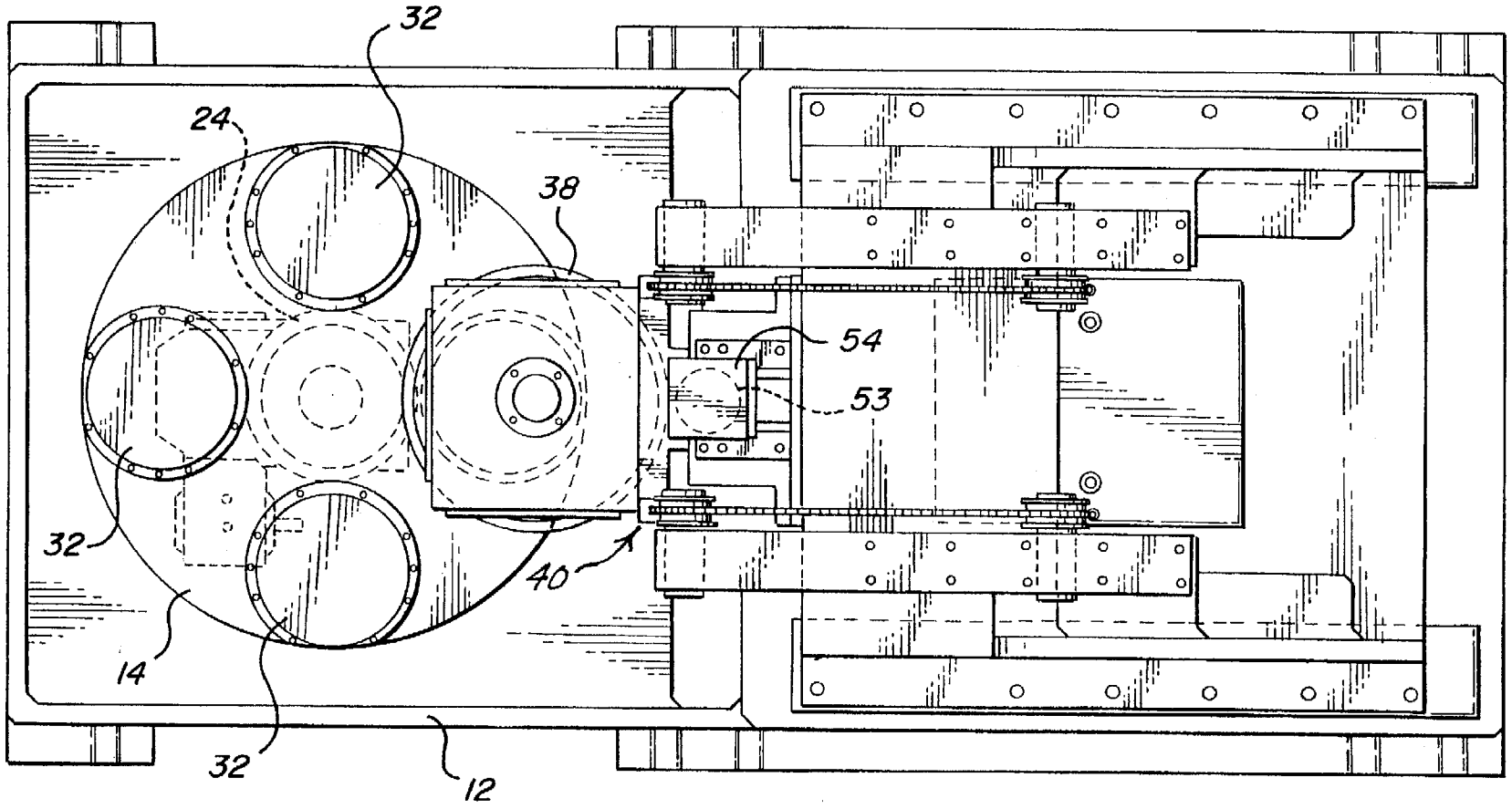
FIG. 3 is a top view of the preferred embodiment.
Figure 4:
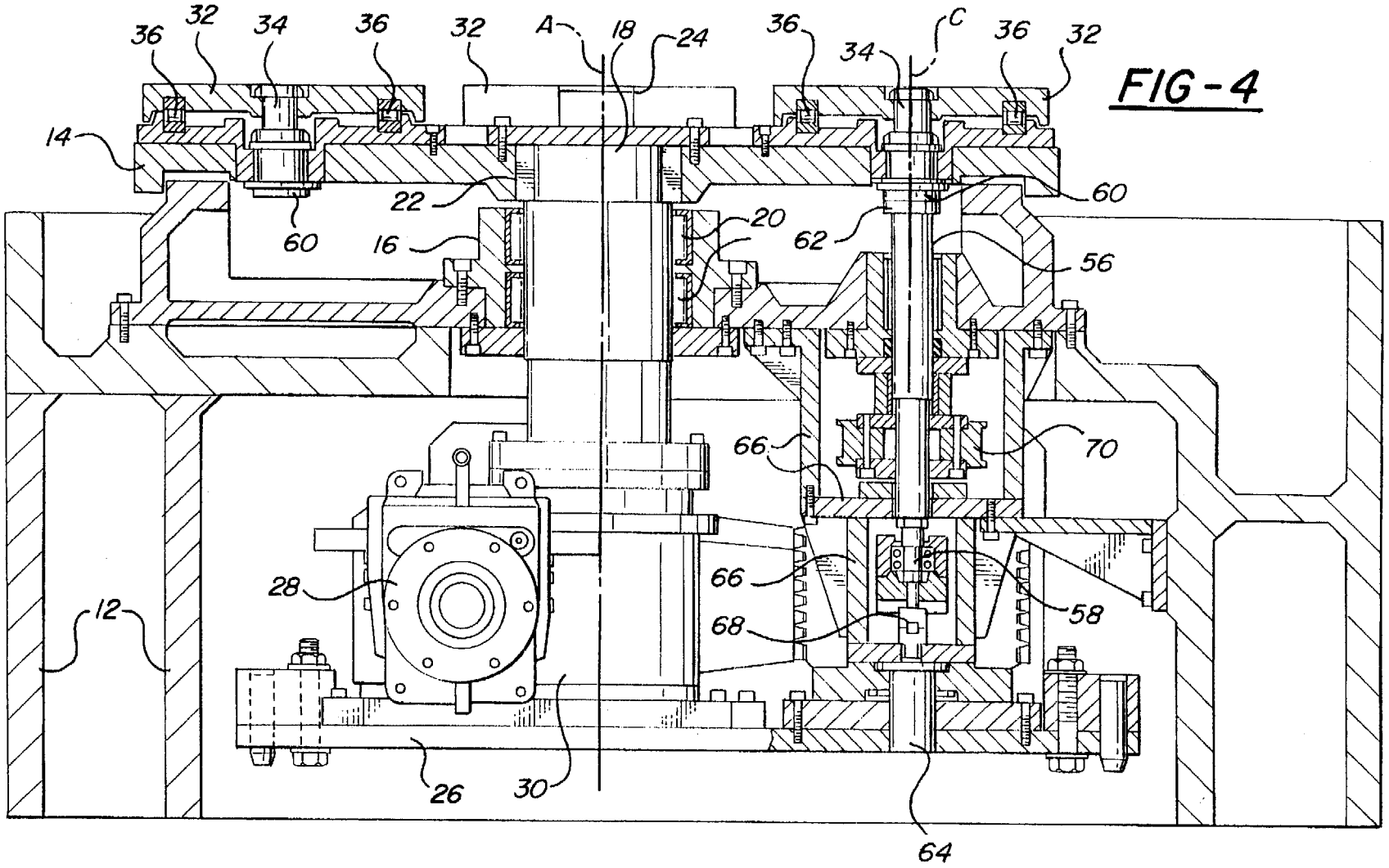
FIG. 4 is an enlarged side view of the bottom portion of the preferred embodiment.

Referring to the Figures, wherein like numerals indicate like or corresponding parts throughout the several views, an abrasive machining assembly is generally shown at 10.

The assembly 10 includes a frame 12 comprising a plurality of castings bolted together to provide a support structure. A worktable 14 is rotatably supported on the frame 12 for rotation about a table axis A. More specifically, a bearing hub 16 is bolted to the frame 12 and rotatably supports a table drive shaft 18 through the bearings 20. A drive key 22 interconnects the table shaft 18 and the worktable 14 so that they rotate together. A lube manifold flange 24 is bolted to the worktable 14 and to the top of the table shaft 18. A mounting plate 26 is supported by the frame 12 and, in turn, supports an electric motor 28. The electric motor 28 rotates the table shaft 18 through a gearbox or equivalent transmission 30.

A plurality of platens 32 are supported on the worktable 14, each of the platens 32 being adapted for supporting a workpiece (not shown) to be machined. Each platen 32 is fixed to a spindle 34 which is rotatably supported by the worktable 14 for rotation about platen axes B. Therefore, each platen 32 is supported for rotation about a platen axis C which is radially spaced from the table axis A a different distance than the tool axis B whereby each of the platens 32 rotates about a platen axis C which is parallel to and offset from the tool axis B when positioned in the workstation.

A machining disc 38 is supported by the frame 12 for rotation about a tool axis C. The tool axis C is spaced radially of the table axis A and at a workstation. A lift mechanism 40 moves the machining disc 38 vertically into and out of engagement with a workpiece on the workstation platen 32. Accordingly, the workstation platen 32 is the platen 32 positioned under the machining disc 38. The electric motor 28 and transmission 30, therefore, define an indexing mechanism for rotating the worktable 14 to serially move each of the platens 32 into the workstation to define a workstation platen 32 and to subsequently move each of the platens 32 out of the workstation.

The lift mechanism 40 comprises an electric motor 42 for rotating the disc 38, the motor 42 being supported on a slide 44 which is, in turn, slidably supported on the guides 46. A chain 48 is entrained over rollers 50 and is connected to counterweights 52 for counterbalancing the weight of the motor 42 and disc 38 assembly. A ball/screw assembly 53 is disposed vertically between the two guides 46 and is driven by a servomotor 54 for moving the disc 38 vertically into and out of engagement with a workpiece on the workstation platen 32. The ball/screw 53 is of the type which may be purchased form Tran-Tek, Inc., of Traverse City, Mich. 49684.

The assembly 10 is characterized by a drive mechanism for selective driving engagement with the workstation platen 32 to rotate the workstation platen 32 and for disengaging the workstation platen 32 during the indexing of the worktable 14 to move the workstation platen 32 out of the workstation while moving another platen 32 into the workstation. This drive mechanism is supported under the workstation and is vertically movable into and out of engagement with the workstation platen 32. The drive mechanism includes a drive shaft 56 having a bottom end 58 and a top end, the top end being vertically movable into and out of coupled engagement with the workstation platen 32 to rotate the workstation platen 32. More specifically, a driven face spline 60 is secured to the bottom of each of the platens 32 and a drive face spline 62 is secured to the top end of the drive shaft 56 whereby the drive face spline 62 is moved vertically into driving engagement with the driven face spline 60 on the workstation platen 32. The face splines 60 and 62 are well known in the mechanism arts and merely comprise mating crossed ridges and grooves.

An actuator 64 is coupled to the bottom end of the drive shaft 56 for moving the drive face spline 62 on the top end of the drive shaft 56 vertically into and out of rotary driving engagement with the driven face spline 60 on the bottom of the workstation platen 32. The framework 66 is bolted or otherwise secured to the frame 12 and supports the pneumatic actuator 64. The pneumatic actuator 64 is connected to the bottom of the shaft 56 through an alignment coupler 68. A timing belt or shaft pulley 70 is splined to the shaft 56 for rotating the shaft 56 as the shaft 56 is free to move vertically through the pulley 70. A shaft motor is coupled to the pulley 70 by a belt entrained thereabout for rotating the pulley 70.

The invention, therefore, includes a method of machining a series of workpieces comprising the steps of:

1) indexing a rotatable worktable 14 about a table axis A to serially move sections of the worktable 14 through a workstation, 2) rotating a platen 32 in each section on the worktable about a platen axis C which is radially spaced from the table axis A, 3) placing a workpiece on each platen 32 before indexing the platen 32 into the workstation, 4) rotating a machining tool 38 about a tool axis B offset from the platen axis C at the workstation, and 5) moving the tool 38 vertically into machining engagement with the workpiece on the workpiece platen 32 in the workstation.

The method is characterized by selectively engaging the workstation platen 32 to rotate the workstation platen 32 only when in the workstation and disengaging the workstation platen 32 during the indexing of the workstation platen 32 out of the workstation and another platen 32 into the workstation. These steps may, of course, be performed in any order and/or simultaneously. Furthermore, the steps may be further defined. For example, by engaging the workstation platen 32 from the bottom by vertical movement into and out of engagement with the workstation platen 32. Or by vertically moving a drive shaft into and out of coupled engagement with the workstation platen 32 and rotating the drive shaft to rotate the workstation platen 32. In the preferred embodiment, the disc 38 is of a cubic boron nitride and is rotated at an rpm sufficient to produce at least 20,000 linear feet per minute. At the same time, the workstation platen 32 is rotated at an rpm significantly slower than the rpm of the tool 38, i.e., in the range of 40 to 500 rpm. As is well known in the art, coolant fluid is communicated to the face of the machining desc via passgaes therein.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An abrasive machining assembly (10) comprising:

a frame (12), a worktable (14) rotatably supported on said frame (12) for rotation about a table axis (A), a plurality of platens (32) supported on said worktable (14), each of said platens (32) being adapted for supporting a workpiece to be machined, a machining disc (38) supported by said frame (12) for rotation about a tool axis (B), said tool axis (B) being spaced radially of said table axis (A) to define a workstation, an indexing mechanism for rotating said worktable (14) to serially move each of said platens (32) into said workstation to define a workstation platen (32) and to subsequently move each of said platens (32) out of said workstation, a lift mechanism for moving said machining disc (38) vertically into and out of engagement with a workpiece on said workstation platen (32), each platen (32) being rotatably supported for rotation about a platen axis (C) which is radially spaced from said table axis (A) a different distance than said tool axis (B) whereby each of said platens (32) rotates about a platen axis (C) which is parallel to and offset from said tool axis (B) when positioned in said workstation, and a drive mechanism supported under said workstation and vertically movable into and out of engagement with said workstation platen (32) for selective driving engagement with said workstation platen (32) to rotate said workstation platen (32) and for disengaging said workstation platen (32) during the indexing of said worktable (14) to move said workstation platen (32) out of said workstation while moving another platen (32) into said workstation and each of said platens (32) being rotatably coupled to said worktable (14) to prevent lifting of said platens (32) from said worktable (14) by said drive mechanism.

2. An assembly as set forth in claim 1 wherein said drive mechanism includes a drive shaft (56) having a bottom end and a top end vertically movable into and out of coupled engagement with the workstation platen (32) to rotate the workstation platen (32).

3. An abrasive machining assembly (10) comprising:

a frame (12), a worktable (14) rotatably supported on said frame (12) for rotation about a table axis (A), a plurality of platens (32) supported on said worktable (14), each of said platens (32) being adapted for supporting a workpiece to be machined, a machining disc (38) supported by said frame (12) for rotation about a tool axis (B), said tool axis (B) being spaced radially of said table axis (A) to define a workstation, an indexing mechanism for rotating said worktable (14) to serially move each of said platens (32) into said workstation to define a workstation platen (32) and to subsequently move each of said platens (32) out of said workstation, a lift mechanism (40) for moving said machining disc (38) vertically into and out of engagement with a workpiece on said workstation platen (32), each platen (32) being rotatably supported for rotation about a platen axis (C) which is radially spaced from said table axis (A) a different distance than said tool axis (B) whereby each of said platens (32) rotates about a platen axis (C) which is parallel to and offset from said tool axis (B) when positioned in said workstation, a drive mechanism for selective driving engagement with said workstation platen (32) to rotate said workstation platen (32) and for disengaging said workstation platen

(32) during the indexing of said worktable (14) to move said workstation platen (32) out of said workstation while moving another platen (32) into said workstation, said drive mechanism being supported under said workstation and is vertically movable into and out of engagement with said workstation platen (32), said drive mechanism including a drive shaft (56) having a bottom end and a top end vertically movable into and out of coupled engagement with the workstation platen (32) to rotate the workstation platen (32), and a driven face spline (60) on the bottom of each of said platens (32) and a drive face spline (62) on said top end of said drive shaft (56) whereby said drive face spline (62) is moved vertically into driving engagement with said driven face spline (60) on said workstation platen (32).

4. An assembly as set forth in claim 3 including an actuator (64) coupled to said bottom end of said drive shaft (56) for moving said drive face spline (62) on said top end of said drive shaft (56) vertically into and out of rotary driving engagement with said driven face spline (60) on the bottom of said workstation platen (32).

5. An assembly as set forth in claim 4 including a shaft pulley (70) connected to said drive shaft (56) for rotating said drive shaft (56).

6. An assembly as set forth in claim 5 including a shaft motor coupled to said pulley (70) for rotating said pulley (70).

7. An assembly as set forth in claim 6 including motor pulley rotated by said shaft motor and said shaft motor is coupled to said shaft pulley (70) by including a belt entrained about said pulleys.

8. An assembly as set forth in claim 7 wherein said actuator (64) comprises a pneumatic cylinder, said indexing mechanism includes an electric motor (28), and said lift mechanism includes a servo motor (54).

9. A method of machining a series of workpieces comprising the steps of:

indexing a rotatable worktable (14) about a table axis (A) to serially move sections of the worktable (14) through a workstation, rotating a platen (32) in each section on the worktable (14) about a platen axis (C) which is radially spaced from the table axis (A), placing a workpiece on each platen (32) before indexing the platen (32) into the workstation, rotating a machining tool (38) about a tool axis (B) offset from the platen axis (C) at the workstation, moving the tool (38) vertically into machining engagement with the workpiece on the workstation platen (32) in the workstation, selectively engaging the workstation platen (32) to rotate the workstation platen (32) only when in the workstation and disengaging the workstation platen (32) during the indexing of the workstation platen (32) out of the workstation and another platen (32) into the workstation, engaging the workstation platen (32) from the bottom by vertical movement into and out of engagement with the workstation platen (32), and preventing vertical movement of the platens (32) from the worktable (14) by the drive mechanism.

10. A method as set forth in claim 9 further defined as vertically moving a drive shaft (56) into and out of coupled (60–62) engagement with the workstation platen (32) and rotating the drive shaft (56) to rotate the workstation platen (32).

11. A method as set forth in claim 9 further defined as rotating the tool (38) to produce at least 20,000 linear feet per minute on the radius of the axis (B) of rotation thereof.

12. A method as set forth in claim 11 further defined as rotating the workstation platen (32) at an rpm significantly slower than the rpm of the tool (38).

13. A method as set forth in claim 11 further defined as rotating the workstation platen (32) at an rpm in the range of 40 to 500 rpm.

* * * * *